US009827597B2

(12) United States Patent
Woodgate et al.

(10) Patent No.: US 9,827,597 B2
(45) Date of Patent: Nov. 28, 2017

(54) SCREEN PANEL LOCKING SYSTEM

(71) Applicant: Lettela Pty Limited, Airport West (AU)

(72) Inventors: Raymond Maxwell Woodgate, Bacchus Marsh (AU); Marc Raymond Woodgate, Bacchus Marsh (AU)

(73) Assignee: Lettela Pty Limited, Victoria (AU)

( * ) Notice: Subject to any disclaimer, the term of this patent is extended or adjusted under 35 U.S.C. 154(b) by 0 days.

(21) Appl. No.: 15/040,028

(22) Filed: Feb. 10, 2016

(65) Prior Publication Data

US 2016/0228916 A1 Aug. 11, 2016

(30) Foreign Application Priority Data

Feb. 10, 2015 (AU) ..... 2015900408

(51) Int. Cl.

*B07B 1/49* (2006.01)
*B07B 1/46* (2006.01)
*B07B 1/40* (2006.01)

(52) U.S. Cl.

CPC ..... *B07B 1/4645* (2013.01); *B07B 1/469* (2013.01); *B07B 1/40* (2013.01); *B07B 2201/02* (2013.01)

(58) Field of Classification Search

CPC ..... B07B 1/46; B07B 1/4618; B07B 1/469; B07B 1/4645; B07B 2201/00; B07B 2201/02

USPC ..... 209/392, 395, 397, 399, 403, 405, 409

See application file for complete search history.

(56) References Cited

U.S. PATENT DOCUMENTS

2013/0037459 A1* 2/2013 Woodgate ..... B07B 1/46 209/405
2013/0140219 A1* 6/2013 Lilly ..... B07B 1/4645 209/405

FOREIGN PATENT DOCUMENTS

AU 2012201297 B2 9/2012
AU 2012208984 B2 2/2013

* cited by examiner

*Primary Examiner* — Joseph C Rodriguez
*Assistant Examiner* — Kalyanavenkateshware Kumar
(74) *Attorney, Agent, or Firm* — Woodard, Emhardt, Moriarty, McNett & Henry LLP; Charles Reeves

(57) ABSTRACT

A screening apparatus includes a plurality of spaced apart parallel beams and a plurality of screen panels mounted to the beams to form a planar screening surface. The panels are mounted to the beams by fixing members that extend in the longitudinal direction of the beams and that engage side edges of the panels. The fixing members have a pair of upstanding, longitudinal rails that are spaced apart to define a longitudinal gap between them and the panels are mounted to the beams by engagement between side edges of each panel with a rail of a fixing member. The side edges of each panel include an overhang that overlies an upper end of each rail and that extends into the gap between the rails. The rails and the overhang include locating gaps to receive a locking member to locate panels relative to the fixing members.

18 Claims, 9 Drawing Sheets

SCREEN PANEL LOCKING SYSTEM

CROSS REFERENCE TO RELATED APPLICATIONS

This application claims priority to Australian Patent Application No. 2015900408 filed on Feb. 10, 2015, which is hereby incorporated by reference in its entirety.

TECHNICAL FIELD

The present invention relates generally to apparatus for screening, separating or grading materials, and is principally for use in the mining industry. The present invention is particularly directed to arrangements for fixing screen panels to the support frame of a vibratory screening machine and to the screen panels themselves. The system and panels are applicable for screening, separating and grading ores and other materials, and it will be convenient to hereinafter describe the invention in relation to that use. It is to be appreciated, however, that the invention is not limited to such apparatus and use.

BACKGROUND OF INVENTION

A reference herein to prior art is not to be taken as an admission that the prior art was known or that it was part of the common general knowledge as at the priority date of any of the claims.

Screening apparatus of the type with which the invention is concerned is generally used for screening, grading, or separating materials such as ores and comprises an array of screen panels which are removably fixed to a frame to provide a continuous screen deck. The material to be screened is fed onto the deck at one end and the apparatus is vibrated so that the material moves over and through its screening surface. The vibration forces are significant.

The screen panels in a screen deck are usually subject to wear, due to the abrasiveness of the mining materials typically being screened, and thus the screens require periodical replacement. This presents a difficulty with the attachment of the panels to the deck frame, as the attachment must be secure and robust and easily made, but it should also be releasable in a manner that is quick and easy. Applicant has developed several different forms of screen panel attachments, examples of which can be found in Australian patent no. 2012201297 and Australian patent no. 2012208984.

In addition to the need for screen panels to be easily attachable and releasable to and from a screen deck frame, screen panels should also be firmly secured in place on the deck and the screen array should not present gaps for passage of screening product or media other than through the openings formed in the screens themselves. If gaps do exist, then incorrect grade screening product can pass through the deck, or the screening product can become embedded between components of the screening deck and can cause wear to the screen panels or the screen deck frame. This can result in the need to clean parts of the vibratory machine or replace parts, either of which results in downtime of the vibratory machine.

Screen decks are therefore formed with either the side edges of adjacent screen panels abutting, or with cover strips employed between adjacent screen panels to overlie any gaps between the adjacent side edges. A screen deck can thus usually be formed without any gaps being present. However, if there is any movement of the screen panels during operation of the vibratory machine, then gaps can result.

One form of movement that can create gaps is movement of screen panels in the direction of travel of the screening product over the screening deck. This type of movement is more likely to occur in so-called multi-slope or "banana" screening decks, in which the lead or initial section of deck is inclined or curved to increase the speed of the screening product across the initial section of the screening deck. Such screening decks can also provide other benefits or effects such as to promote water shedding from the screening product. For at least these reasons, the use of multi-slope screening decks is preferred in many installations. However, in the inclined or curved section of the screening deck, the screening product moves at high speed and the forces associated with that movement tends to push the screen panels over which the screening product travels. If the screen panels move under that load, gaps between panels can arise.

The present invention seeks to provide an arrangement in which movement of screen panels in the manner described above is minimised or eliminated. The elimination of movement is intended once the screen panels have been finally positioned or installed, such that in some forms of the invention, movement of the screen panels is allowed during installation, but is prevented once the panels have been fully installed ready for operation of the vibratory machine.

SUMMARY OF INVENTION

According to the present invention there is provided a screening apparatus, including:

a plurality of spaced apart, substantially parallel elongate beams, a plurality of screen panels mounted to the beams to form a broad screening surface, each of the panels having a generally square or rectangular shape defining a first pair of substantially parallel edges and a second pair of substantially parallel edges, and the panels being mounted adjacent to each other so that facing side edges of adjacent panels are in close facing relationship, each panel being mounted to a pair of beams to bridge between two adjacent beams, the panels being mounted to the beams by elongate fixing members that extend in the longitudinal direction of the beams and that engage the first pair of side edges of the panels, the fixing members having a pair of upstanding, generally longitudinal rails that are generally parallel and that are spaced apart to define a longitudinal gap between them, the panels being mounted to the beams by cooperation between the first pair of side edges of each panel with a rail of a fixing member, the first pair of side edges of each panel including a longitudinal overhang that overlies an upper end of a rail and the overhang entering the gap between the rails, each of the rails of each fixing member and the overhang of each panel being interrupted to form gaps that are aligned and within which a locking member is disposed to locate the panel relative to the fixing rail against movement of the panel along the fixing rail.

A screening apparatus as above described advantageously secures the screen panels in place on the fixing members against movement longitudinally of the fixing members by the use of the locking members. The locking members bear against the inside or facing surfaces of the locating gaps and because the locating gaps include gaps formed in both the screen panels and the fixing members, engagement of the locking members with both the screen panels and the fixing members locks the screen panels relative to the fixing members. This reduces the likelihood, or even ensures that gaps between adjacent screen panels do not form by longitudinal movement of the screen panels, such as due to the screening product pushing the screen panels during travel over the screen deck.

A further advantage of the present invention is that the aligned gaps formed in the overhang of each panel and the fixing members form lifting positions for lifting a screen panel from a fixing rail for the purpose of removing the screen panel for replacement. A suitable tool can be used for this purpose and in most cases, a screwdriver or like tool can be used to lever a screen panel from a fixing member through the aligned gaps. Before a screen panel can be removed, the locking member that is inserted into the aligned gaps must be removed, but the same tool that is used to remove a screen panel can be used to lever a locking member out of the aligned gaps. Thus, removal of screen panels for replacement purposes can be quick and easy and requires no particular skill or specialised tools.

While the defined requirement is that adjacent panels are mounted so that facing side edges of adjacent panels are in close facing relationship, it is intended that adjacent panels are mounted so that facing side edges are in touching engagement along those facing side edges so that a seal is created between facing side edges against passage of screening product past facing side edges. However, applicant recognises that where adjacent panels are not properly aligned, small gaps might exist between facing side edges and therefore the requirement for mounting the panels to be in close facing relationship is intended to cover both arrangements in which facing side edges are in touching engagement as well as where small gaps exist between facing side edges.

The overhangs of two adjacent screen panels can engage in order to seal the junction or engagement between those two panels and in some forms of the invention, each overhang can present an engagement surface for engagement with a facing engagement surface of the overhang of an adjacent screen panel. The engagement between the facing engagement surfaces can be within the gap between adjacent rails of a fixing member, or can be external to that gap, i.e. above the gap or laterally spaced from the gap, or the engagement between the facing engagement surfaces can be a combination of within the gap as well as external to that gap.

The preferred arrangement is that the engagement surfaces engage at least within the gap between adjacent rails but preferably also above the gap such as to the upper or screening surface of the screening apparatus. The preference is that the engagement surfaces be substantially flat surfaces and the further preference is that those surfaces extend substantially perpendicularly to the plane of the screening surface.

In the above arrangement, the screen panels can have an identical shape, which has advantages in production and storage of panels (reducing the number of different panels needing to be stored), while installation is facilitated given that the single form of panel can be used across a complete screening deck.

The rails of the fixing members can be made from any suitable materials, such as plastics or polymers, but in some forms of the invention, a polyurethane material is employed. This means that the rails can be flexible and while that can assist installation of screen panels into the screening apparatus, once the screen panels are installed, the preference is that the rails do not move or flex. Accordingly, by arranging for engagement between the overhangs of adjacent screen panels, the rails of the fixing members can be fixed in place via their engagement or cooperation with the side edges of the screen panels against flexing or tipping movement.

In one particular form of the invention, the cooperation between the first pair of side edges of each panel and a rail of a fixing member includes a projection that extends either from one of the side edges of each panel or the rail of a fixing member, and a groove which is formed in the other of the side edges of each panel and the rail, within which the projection is received. The projection can extend generally in a plane that is parallel to the plane of the screening surface, and the projection and groove can be located between a beam of the screening apparatus to which the screen panels are mounted and the overhang of the screen panel. By this arrangement, once the projection is received within the groove, the screen panel is located relative to the fixing member against lifting away from each of the fixing member and the beam to which the fixing member is mounted.

In order to form the groove and projection arrangement discussed above, the rails of the fixing members can extend from a base and can include an upright web section and a head that is formed at an upper end of the web section. In this arrangement, a groove can be formed between the base and the head for receipt of a projection which extends from the side edge of each panel. The base and the head can form facing surfaces of the groove. The projection can be a longitudinal projection, or a series of disconnected projections that extend in a longitudinal path or direction. The projection can be interrupted in the same manner as the overhang and the rails of the fixing member to form a gap for receipt of a locking member, although in alternative forms of the invention, the projection can be continuous without interruption, with the gap for the locking member formed above it.

Where the rails include a web section and a head, the overhang can extend over the head and into the gap between adjacent rails. To facilitate insertion of a portion of the overhang into the gap, that portion of the overhang that does extend into the gap can have an inclined face that can be placed or pushed into engagement with the head of the rail and thereafter will ride along the inclined face as it is pushed further into the gap. The inclined face can extend for the full portion of the overhang that extends into the gap, or for a section of the portion that extends into the gap.

In arrangements in which facing surfaces of adjacent overhangs engage, the engaging faces can seal against passage of screening product past the junction of the engaged faces. This differs from some prior art arrangements in which facing surfaces of adjacent overhangs do not engage and which therefore include "locking strips", that overlie the junction between facing edges of adjacent screen panels to seal the junction. The arrangement of the present invention is particularly appropriate where the screening product is a "dry" screening product such as iron ore, bauxite or copper. These types of products are less able to pass between engaged faces and the absence of a locking strip means that the cost of installation of the screening apparatus is reduced, as is the complexity of installation.

A single locking member can be employed to locate facing first edges of a pair of adjacent screen panels against movement along the fixing rail. Thus, the overhang of each of the first pair of edges of each screen panel can include a single gap to accommodate insertion of a single locking member. Alternatively, the overhang of each of the first pair of edges of each screen panel can include two gaps that are spaced apart to form two locating gaps between adjacent screen panels and the rails of the fixing members can include corresponding gaps for alignment with the locating gaps of the two overhangs. In this arrangement, the screen panels can be located relative to the fixing rail against movement along the rail by a pair of locking members inserted into two separate locating gaps. In this arrangement, the gaps can be formed towards opposite ends of the first edges of each screen panel so that the locating members locate the screen panels towards the corners thereof.

In still alternative arrangements, more than two locating members can be employed along the first edges of a screen panel, although it is expected that one or two locating members will properly locate a screen panel. The preference is for two locating members as discussed above being located towards corners of each screen panel.

The locking members can be located in any suitable manner within the locating gaps to locate the screen panels relative to the fixing members. To resist release of the locking members from within the locating gaps, the locking members could be threaded, with the walls of the aligned gaps including threaded portions. Alternatively, the locking members could extend through and into the beam and be fixed by a locking nut or clip or the like beneath the beam.

However, the preferred arrangement at this stage to resist release of the locking members from within the locating gaps is for the locking members to each include at least a pair of projections that project from opposite sides of the locking member for engaging under a projection formed in the facing first edges of adjacent screen panels or in facing surfaces of the fixing members. The preference is for the projections to be formed in the facing first edges of adjacent screen panels.

Where projections extend from the facing edges of the screen panels, the projections of the locking member will underlie the projections extending from the facing edges of the screen panels and thus hold the locking members in place against upward release out of the locating gaps. This arrangement is easy to assemble, given that the locking members can simply be pushed into the aligned locating gaps and once the locking member projections have reached a position of underlying the edge projections, release of the locking members from the aligned locating gaps is not possible without an external force being applied, such as by a screwdriver or like tool. Such an arrangement can withstand the load placed on the screening deck by a vibratory machine and is extremely simple from the point of view of manufacturing the locking members, as well as from the point of view of installing them as described above. Moreover, whether locking members are made from polyurethane or like material, a screwdriver or like tool can be inserted between side edges of the aligned gaps and the locking member to lever at the locking member out of the aligned gaps.

The projections that extend from opposite sides of the locking member can extend in a direction which is generally perpendicular to the longitudinal extent of the fixing members, or alternatively, generally parallel to the longitudinal extent of the fixing members, or in both directions. For example, the locking members can include four projections. Where the locking members are square, the four projections can each extend from a face of the locking member.

Moreover, the projections of the facing first edges of adjacent screen panels can be formed in a portion or portions of the overhang of each of the screen panels within which the locating gap is formed. That is, edges of the overhang that define the gap formed in the overhang can form the/or part of a projection under which a locking member projection can be located. This means additional and separate projections are not required. Again, this arrangement simplifies the structure of the screening apparatus by employing portions of the overhang to form the projections under which the locking member projections are seated.

The locking member can be of any suitable shape, including square, rectangular, circular or oval. However, a preferred shape of a locking member is square or rectangular and in that form of locking member, two or four projections can be included. The preference is to include four projections, being one projection extending from each wall of the locking member. In this preferred form, the walls of the overhangs of the screen panels that form the gaps for receipt of a locking member can form or constitute projections for cooperation with the projections of the locking members and the projections of the overhangs can be formed continuously by the entire wall, or by a portion of the wall. The projections of the walls of the overhangs can, for example, be formed by the underneath surfaces of the walls, instead of having actual projections that extend from the walls.

A screening apparatus according to the present invention can also include a side clamp, which is positioned against each of opposing side walls of a screening apparatus and which has a bottom surface that bears against the upper surface of edges of screen panels that face the side walls, to hold the edges of screen panels that face the side walls against lifting. The side clamp extends longitudinally of the screening apparatus for substantially the extent of the screen panels and cooperates with a clamping arrangement which engages an upper edge of the side clamp to push or press the side clamp downwards. The side clamp also includes a spacing arrangement along a bottom edge thereof for taking up space between the side wall and the facing edge of the adjacent screen panels. In this respect, once a screening deck has been assembled, there is usually a small space between side walls of the screening apparatus and the facing edges of the adjacent screen panels. The side clamp is arranged to take up that space to prevent or resist movement of the screen panels at the side wall.

In the present invention, the spacing arrangement has a plurality of spaced apart projections that extend downwardly from the bottom surface of the side clamp and which include a connection arrangement to releasably connect spacers to the projections to take up space between side walls of the screening apparatus and the facing edges of the adjacent screen panels.

The connection between the projections and the spacers can be any suitable connection, including a threaded connection, a bayonet connection or a snap fit connection. However, in some forms of the invention, the spacers include a head, a neck and a base, with the diameter of the neck being less than each of the diameter of the head and base. The spacers in this arrangement can be formed from a flexible material, such as polyurethane, and each of the projections can include an opening which is of a diameter that is similar to the outside diameter of the neck. The length of the neck is substantially equivalent to the length of the opening through the projections, and in this form of the invention, the spacer is connected to the projection by pushing or forcing the base and neck through the opening so that the base deforms for passage through the opening and reforms or recovers upon release from the opening. The neck is captured in the opening with the head and the base on either side of the opening.

It is predominantly the head that takes up the space between side walls of the screening apparatus and the facing edges of the adjacent screen panels. The base would normally bear against the side wall on the side of the projection remote from the side edge of the screen panels. Beneficially, because the space between side walls of the screening apparatus and the facing edges of the adjacent screen panels can vary depending on the screen panels in use and the frame to which the screen panels are being assembled, the use of releasable spacers means the depth of the spacer can be selected based on the space to be taken up. For example, a spacer of greater depth can be used for a larger gap between the side edges and the side walls compared to a smaller gap.

Further advantageously, the present invention allows a single side clamp to be used in screening apparatus regardless of the spacing between the side edges of the panels and the side walls. The depth of the spacers can be selected for the space to be taken up.

BRIEF DESCRIPTION OF DRAWINGS

In order that the invention may be more fully understood, some embodiments will now be described with reference to the figures in which.

DETAILED DESCRIPTION

Figure 1:
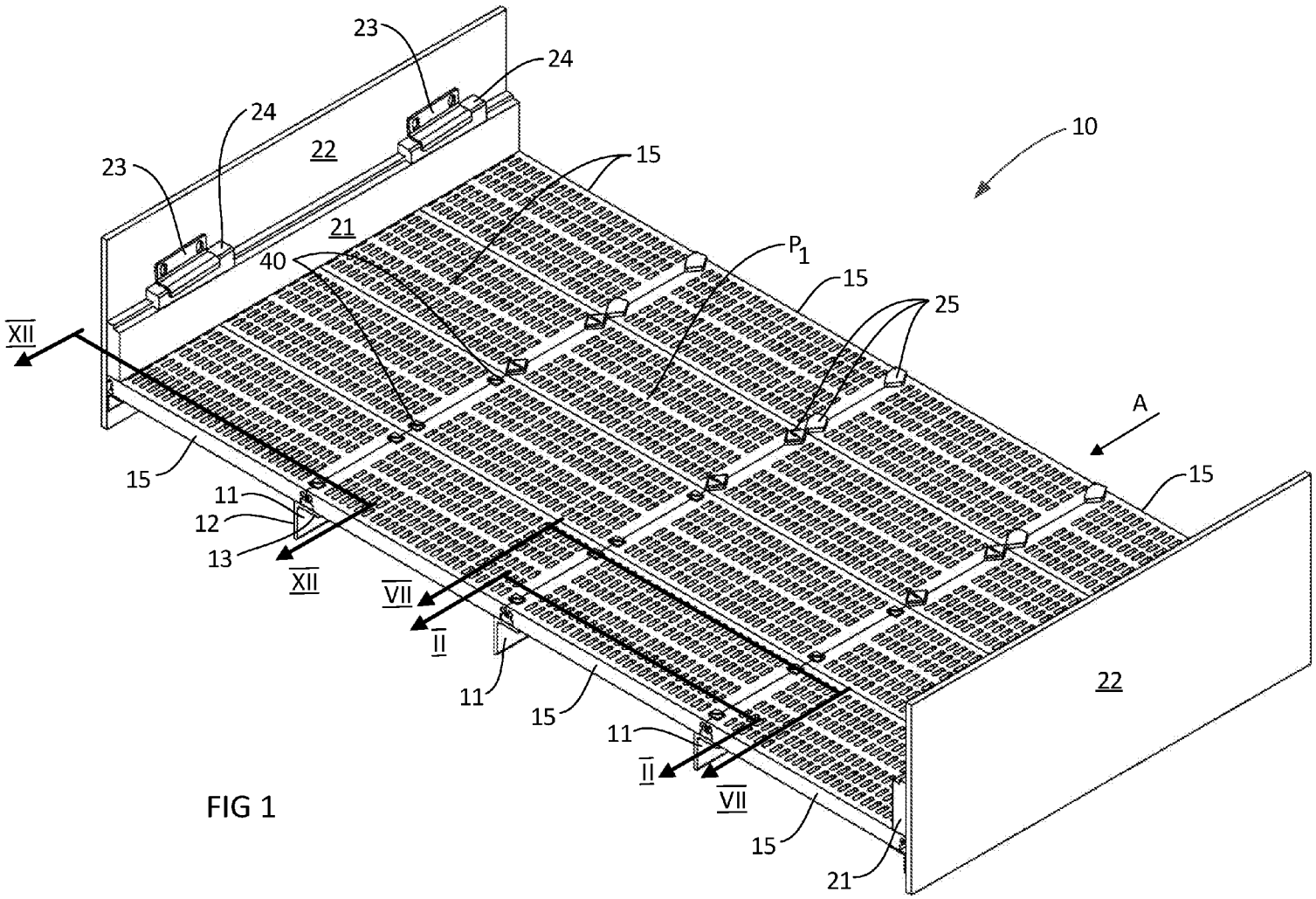
FIG. 1 is an isometric view of a portion of a screening deck according to one embodiment of the invention.

With reference to FIG. 1, a portion of a screening deck 10 is illustrated, comprising a plurality of elongate, longitudinal beams 11 each of which is formed from an angle of steel having a long portion 12 and short portion 13. The portions 12 and 13 are set at right angles to each other. While the beams 11 extend in the longitudinal direction of the screening deck 10, the beams 11 can equally extend perpendicular to the direction shown.

The deck 10 illustrated in FIG. 1 is a portion of a deck only and illustrates a depth of four screening panels 15. The longitudinal length of the deck 10, in the direction of the beams 11 can be much greater.

The beams 11 extend parallel to one another and support the panels 15 on the upper face of the short portion 13 of each beam 11. The panels 15 illustrated in FIG. 1 can be of any suitable size, but a common size is 305 mm by 610 mm. The screening deck 10 is one part of an overall screening apparatus. The screen deck 10 is supported on a sub frame which includes the beams 11 and which is part of a vibratory screen machine. The vibration that is generated is significant and requires the panels 15 to be securely fixed to the beams 11. The panels 15 are also subject to wear over time and even though the fixing of the panels 15 to the beam 11 are required to be secured, the preference is that the panels are also easily releasable to facilitate replacement.

The panels 15 include a plurality of openings through the top surface thereof for screening product such as mining ore. The openings in the panel can vary from large to very small depending on the screened media required from the screening process.

Typically, ore is fed onto one end of the deck 10 and the deck is vibrated so that the ore tends to shift from one end to the other with some of the ore passing through the openings of the panels 15 as it travels over the deck. Depending on the operation, the valuable ore could be the ore which passes through the openings, or the ore which remains on the deck. The panels 15 are attached to the screen deck 10 via elongate fixing members 20 which are mostly obscured in FIG. 1, but which are shown in other figures. The fixing members 20 are fixed to the upper surface of the short portion 13 of the beams 11 by any suitable arrangement, such as bolts. The fixing members can extend for a single length of a single panel 15, or, more preferably, for a greater number of panels, such as five panels.

Most of the panels 15 will be in face to face engagement along side edges of each panel. For example, the panel marked $P_1$ is engaged with facing edges of other panels 15 on all four edges. It is preferred that the panels have this face to face engagement, in order to prevent or minimise screening product from entering into the junction between adjacent panels 15 and through that junction to the beams 11 below or into the screened product that is collected below the screen deck. Any entry of such screening product between adjacent panels 15 can cause wear to the fixing members 20, or to the beams 11, thus compromising operation of the screening deck 10. With sufficient wear, worn components must be replaced and that results in down time of the screening apparatus. Wear of certain components, such as the beams 11, can require significant down time in order to replace the components. It is therefore important that the panels 15 be fixed to the deck 10 securely and with firm side edge engagement between adjacent panels.

It is to be noted that the deck 10 includes side clamps 21 at each side of the deck 10, and in facing engagement with side walls 22. Side clamps 21 clamp via a bracket 23 and wedge 24 onto the upper edge surface of the panels 15 for the purpose of preventing lifting of the facing edge of the panels 15, preventing ingress of screening product between the side edges of the panels 15 and the walls 22, and also to protect the walls 22 (which are usually steel walls), from the impact of screening product which traverses the screen deck 10. The side clamps 21, like the panels 15, are usually made from a polyurethane material. The side clamps 21 can be used with a screening apparatus of the invention or with prior art screening apparatus.

The manner in which the screen panels 15 interact with the fixing members 20 will be described hereinafter. For that discussion, it is important to note from FIG. 1, the existence of locking members 25 that assist to locate the panels 15 relative to the fixing rails 20 against movement of the panels 15 along the fixing rails. In this respect, while the deck 10 is shown as a flat, screening decks generally operate on an incline to promote travel of ore from one end of the deck (the feed end) to the other (the discharge end), and some decks incorporate inclined sections (these can be referred to as "multi-slope decks"), in order to increase the speed of ore from the feed end to the discharge end. The inclined sections can have a greater inclination at the start of the deck and reduce towards only a slight inclination so that screening product decelerates from a high speed at the entry or initial section of the screening deck, to a lower speed when the screening deck flattens out to a slight incline. These types of decks process the screening product more quickly than decks that have only a slight and constant incline over the length of the deck because the screening product travels over the deck more quickly due to the more greatly inclined sections.

Particularly in the multi-slope types of decks, there is tendency for the screening panels to shift in the direction of screening product movement due to the loads placed on the panels by the moving screening product and that shift can cause gaps to open between adjacent panels and for screening product to fall through those gaps causing the problems mentioned above in relation to wear of deck components or contamination of screened product. For this reason, the present invention is intended to lock the panels 15 firmly in position on the fixing members 20 in order to prevent such panel shifting movement. That locking however is intended to be selective in that the invention can allow movement of the panels 15 relative to the fixing members 20 to allow proper and accurate location of the panels 15 on the fixing members 20, but once the panels 15 are correctly located, the panels can be locked against further movement relative to the fixing members 20. This differs from some prior art arrangements where the screening panels are locked as soon as they are fixed to the fixing members, so that initial pre-fixing movement along the fixing members is not provided or allowed.

Figure 2:
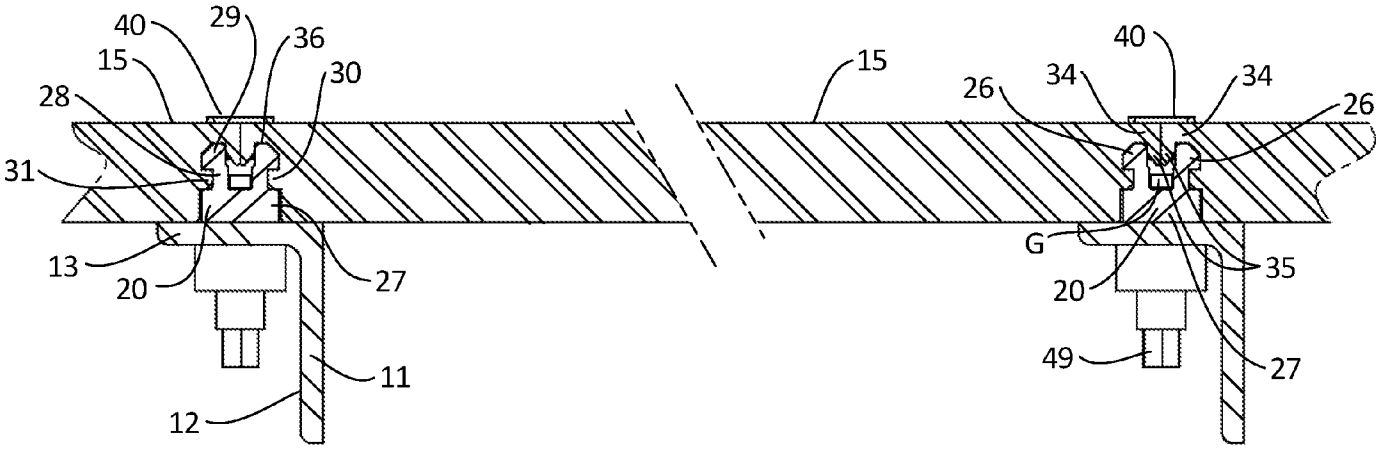
FIG. 2 is a cross sectional view through II-II of FIG. 1 showing the connection between adjacent screening panels in the deck illustrated in FIG. 1.
Figure 3:
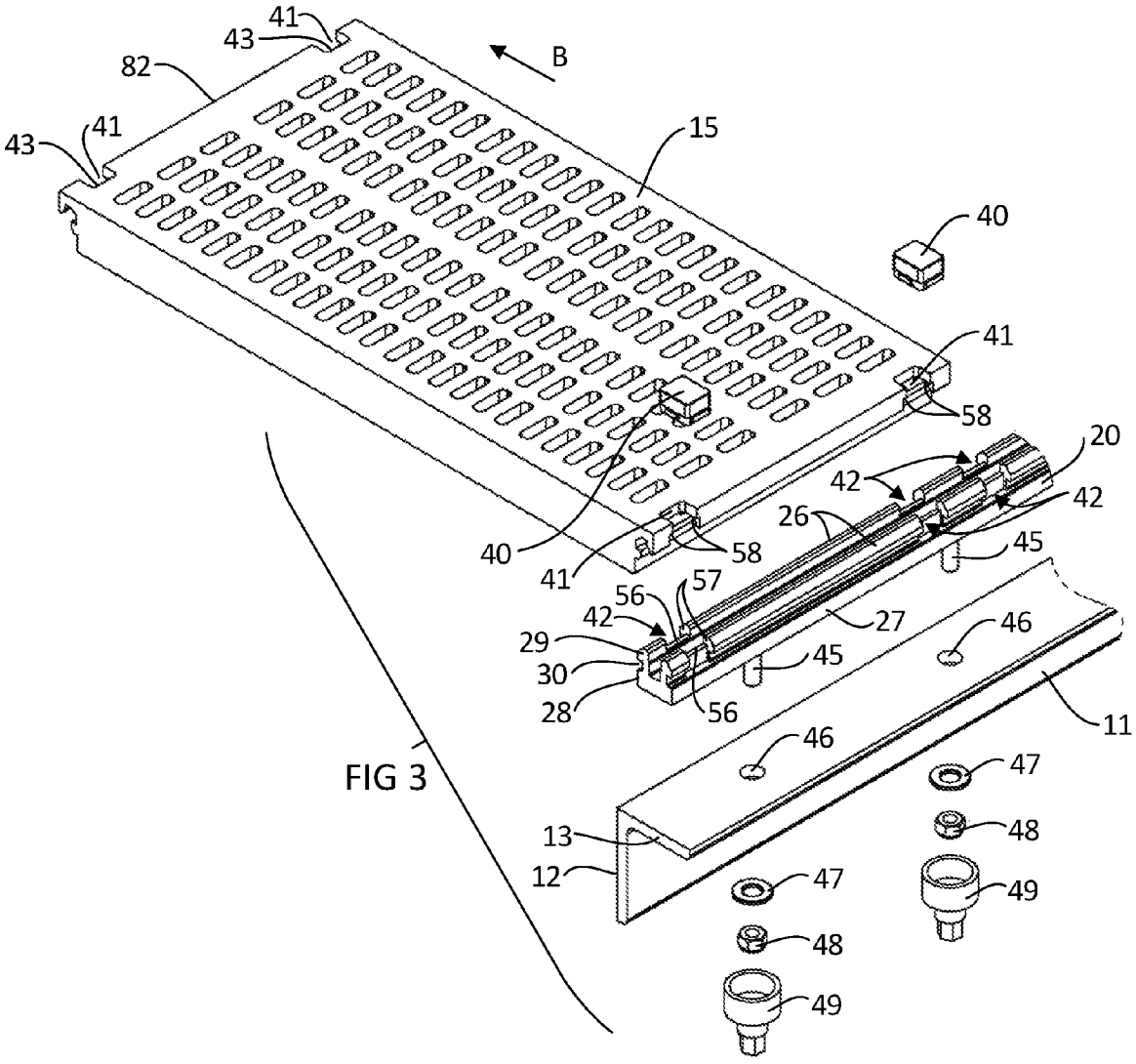
FIG. 3 is an exploded view of a single screening panel and its connection to the deck of FIG. 1.
Figure 4:
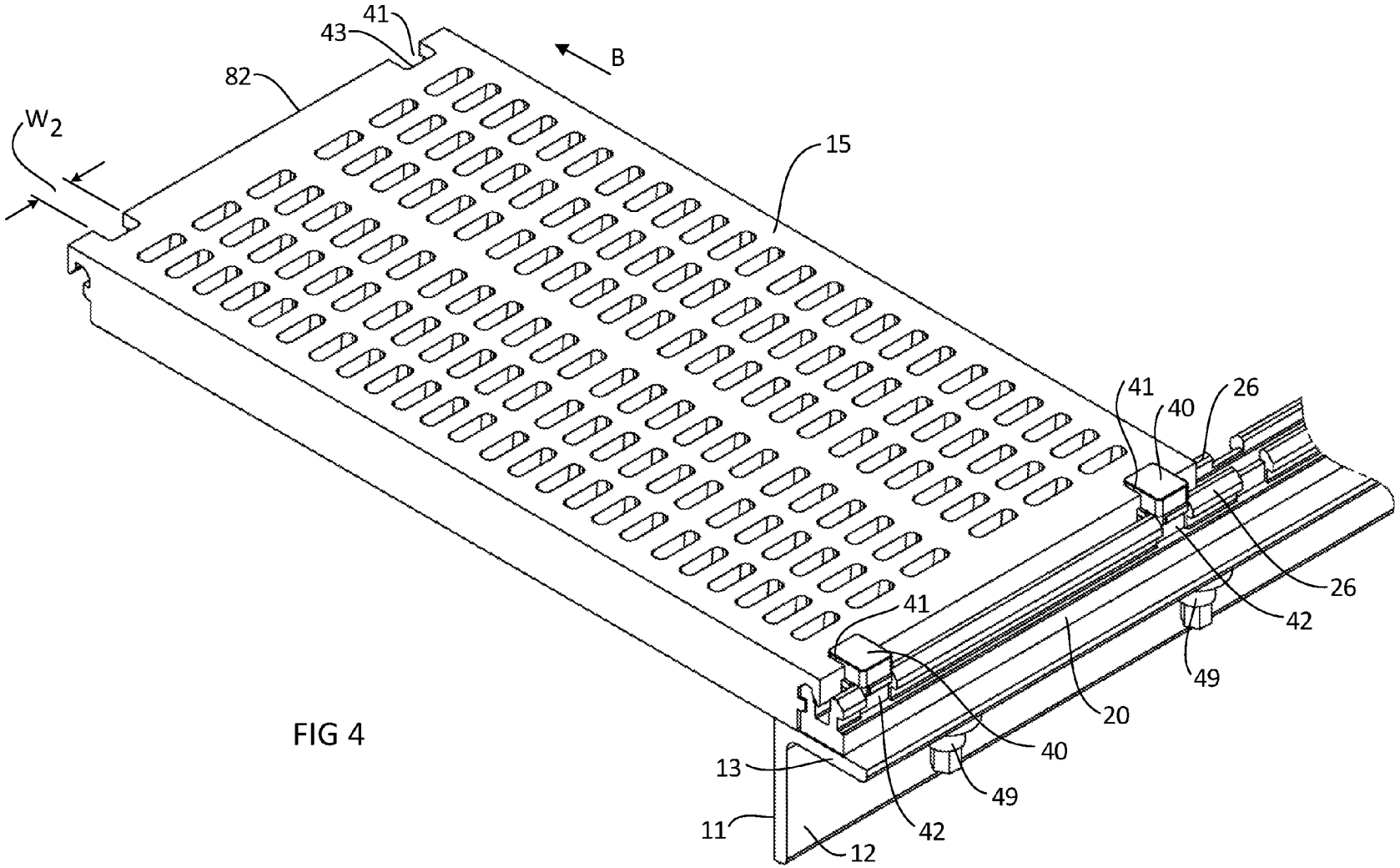
FIG. 4 is an assembled view of the arrangement of FIG. 3.

With reference to FIG. 2, a cross-sectional view of one full panel 15 (the central panel), and side edges of two adjacent panels 15 (to the left and right of the central panel) is illustrated. FIGS. 3 and 4 are exploded and assembled views of a single panel 15 relative to a single fixing member 20. FIGS. 2 to 4 show the configuration of the fixing members 20 and show that the fixing members 20 include a pair of rails 26 which extend from a base 27 and which are formed by webs 28 and heads 29. Recesses 30 are defined between the base 27 and the heads 29 and it can be seen that the side edges of the panels 15 each include a projection 31 that extends into the recesses 30 in order for the side edges of the panels 15 to cooperate with the rails 26 of the fixing members 20 to fix the panels 15 to the fixing members 20 and thus to the beams 11.

The side edges of the panels 15 also include a longitudinal overhang 34 (FIG. 2) that overlies the upper end of the rails 26, or in other words overlies the heads 29 and includes a downwardly extending portion 35 that extends into the gap G (FIG. 2) between adjacent rails 26. It is intended that facing surfaces of facing portions 35 engage tightly to prevent ingress of screening product between the portions 35 and into the fixing members 20.

The panels 15 are securely located on the beams 11 by cooperation between the projection 31 of the side edges of the panels 15 within the recess 30 of the fixing members 20. The panels 15 can be connected to the fixing members 20 by the projections 31 riding down the inclined surface 36 of the heads 29 and by the rails 26 bending inwardly towards each other as the projection 31 moves over the inclined surface 36 for insertion into the recess 30. With the projection 31 seated within the recess 30, the portion 35 is positioned within the gap G, and when a pair of panels have been assembled to the fixing member 20 as shown in FIG. 2, the respective portions 35 engage and prevent inward flexing or tipping of the rails 26 towards each other. By this arrangement, side edges of the panels 15 are securely held in place on the fixing members 20 by the secure engagement of the projections 31 within the recesses 30.

However, as indicated above, it is a feature of the invention that the panels 15 are not only secured in the array formation shown in FIG. 1, but also against movement along the fixing members 20. In the illustrated form of the invention, prevention of that latter form of movement is by the use of locking members 40 that fit into locating gaps which are formed in the overhang 34 and in the rails 26. With reference to FIG. 3, gaps 41 are formed in the overhang 34, while gaps 42 are formed in the rails 26 of the fixing member 20. The gaps 41 and 42 form a locating gap into which the locking member can be inserted.

With reference to FIG. 4, with the gaps 41 and 42 aligned, or overlaid, the locking members 40 can be inserted and it will be appreciated that once inserted, the locking members 40 lock the position of the panel 15 on the fixing member 20 through engagement with the edges of the gaps 41 and 42. While the locking members 40 remain in place, movement lengthwise of the panel 15 along the fixing member 20 is not possible.

The figures mentioned above also show the manner by which the fixing members are fixed to the beam 11 and while this is a relatively standard arrangement, it will be briefly described as follows.

Extending from the base 27 of the fixing member 20 are a pair of projections 45 (FIG. 3) that extend through openings 46 in the portion 13 of the beams 11 and while the projections 45 are not shown as being threaded, they include a thread over which the washers 47 pass and on which the nuts 48 thread. The nuts 48 tighten the fixing members 20 onto the beam 11, while a urethane cap 49 is also threaded onto the end of the 45 to protect the fixing arrangement (the projections 45, washers 47 and the nuts 48) against the corrosive effect of fines (very fine screening product).

Figure 5:
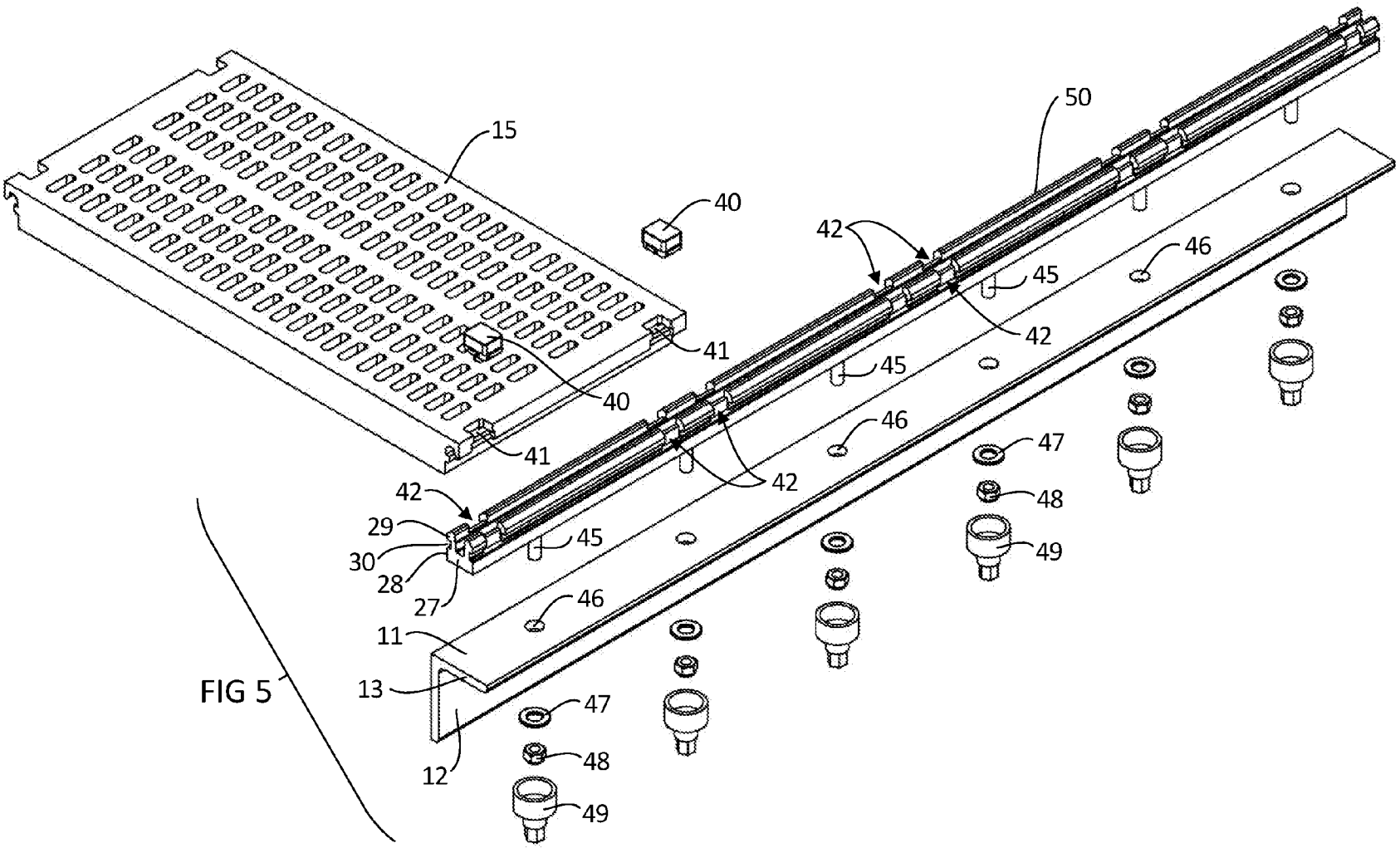
FIG. 5 is an exploded view of a single screening panel and its connection to the deck of FIG. 1 but showing an elongate fixing member.

The fixing members 20 can be of any length suitable to secure one or more panels 15. FIG. 5 illustrates a fixing member 50 that is of a length suitable to fix four panels 15 thereto. It is envisaged that for commercial use, the fixing members 20 will have at least the length shown in FIG. 5 but potentially a greater length, although a smaller length is possible.

Figure 7:
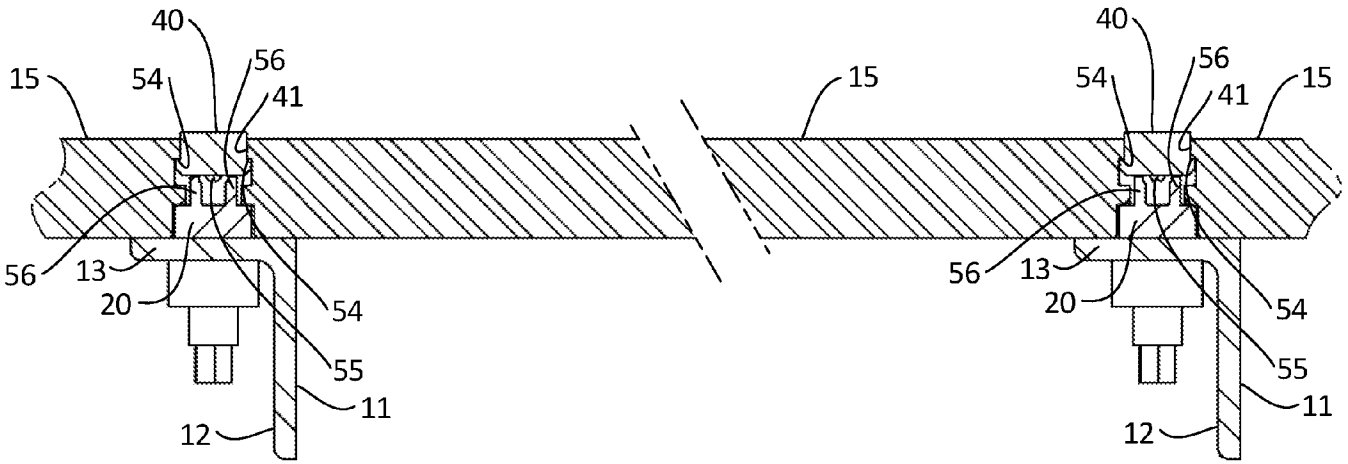
FIG. 7 is a cross sectional view through VII-VII of FIG. 1 showing the locking member of FIG. 6 in place.
Figure 6:
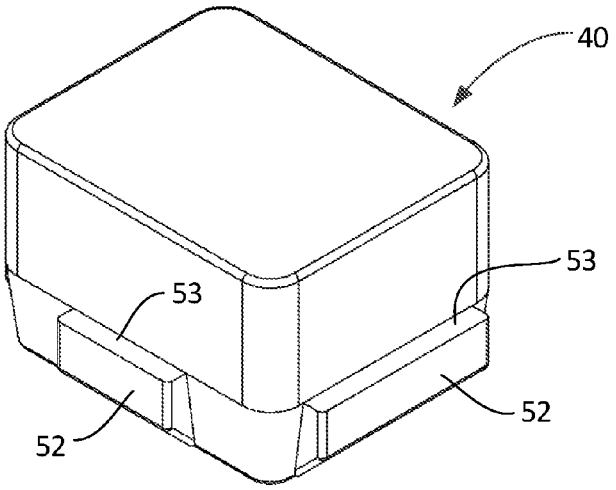
FIG. 6 is an isometric view of a locking member according to one embodiment of the invention.

The locking members 40 must firmly lock into the gaps 41 and 42 and must be constructed to maintain that locking engagement under operation of the deck 10 during a screening operation in which the deck is vibrated. Accordingly, the locking members 40 include a construction that is illustrated in FIGS. 6 and 7 and with reference to those figures, it can be seen that the locking member 40 has a generally rectangular shape and includes four projections or undercuts 52. Each undercut 52 projects from a side wall or edge of the locking member 40 and includes an upper surface 53. As shown in FIG. 7, two of the undercuts 52 on opposite sides of the locking members 40 engage a downwardly facing surface 54 of the inner edges or walls of the gaps 41 in adjacent panels 15 in order to lock the locking members 40 in place. The other two the undercuts 52 engage a downwardly facing surface of the other walls (the side walls) of the gaps 41 as will be below. The locking members 40 are intended to be a tight fit within the locating gaps formed by the overlying gaps 41 and 42.

There is sufficient flexibility in the undercuts 52 in order to simply push the locking members 40 into the gaps 41 of an adjacent pair of panels 15 with the undercuts 52 compressing or deflecting to allow the locking members 40 to enter the gaps 41 and for the undercuts 52 to thereafter splay or flex outwardly once the upper surface 53 has penetrated to a position just below the downwardly facing surfaces 54. As shown in FIG. 7, the bottom face 55 of each locking member 40 rests on upwardly facing surfaces 56 (see FIGS. 3 and 4), of the rails 26 in the region of the gaps 42. By this arrangement, each of the panels 15 and the locking member 40 are firmly secured in place and because the locking member 40 is a tight fit within the gap 42, so that it bears against facing surfaces 57 (see FIG. 3) of the heads 29 of the rails 26, longitudinal movement of the locking members 40 is precluded and thus longitudinal movement of the panels 15 is also precluded.

While the undercuts 52 engage the surfaces 54 of the inner walls of the panels 15 as shown in FIG. 7, the undercuts 52 also engage further downwardly facing surfaces 58 of the side walls that extend from the inner walls as shown in FIG. 3, so that the locking member 40 is secured against release out of the gaps 41 and 42 on each of its four sides. This forms a highly secure fitting.

Figure 8:
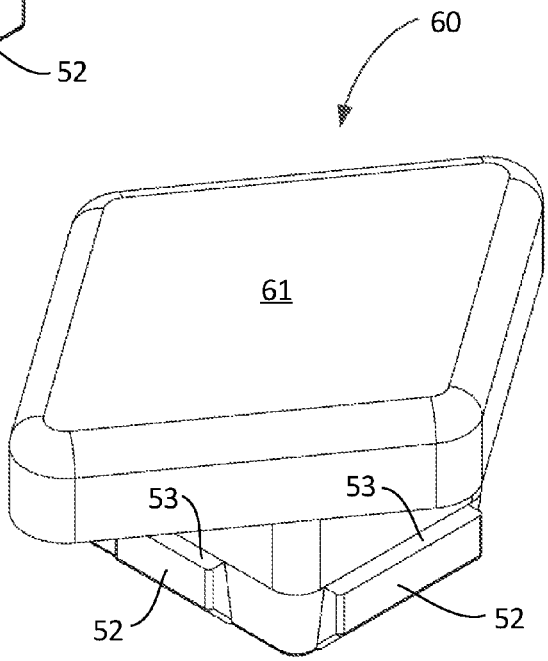
FIGS. 8 and 9 show alternative forms of locking members according to the invention.
Figure 9:
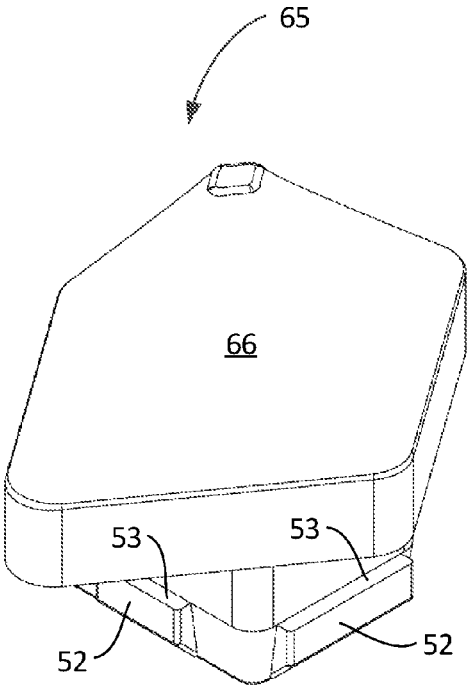

Locking members 25 and 40 are illustrated in FIG. 1, and from this, it can be seen that the locking members 25 have different shapes on the surface of the deck 10 to the locking members 40. The form of the locking members can vary and two other forms are illustrated in more detail in FIGS. 8 and 9. Each of the locking members 40, 60 and 65 have the same bottom or base end defining a rectangular shape with four undercuts 52. It is only the upper part of the locking members that differ and in FIG. 8, the locking member 60 is shown to have a diamond shaped upper end 61, while in FIG. 9, the locking member 65 has a pyramid shaped upper end 66. The upper ends 61 and 66 are shaped as deflectors, so that screening product travelling along the deck 10, that travels along the adjoining sections of adjacent panels 15 in which no screening openings exist, is deflected back onto portions of the screening panels that do have screening openings.

Returning to FIG. 1, it will be evident that the arrangement which exists between adjacent side edges of adjacent panels 15 cannot be employed along the walls 22 of the deck 10 because there is no adjacent panel for the side edge panels to engage or abut. Nevertheless, is it important to secure the panels at the edges against longitudinal movement of the deck 10 at the side walls 22, so that the panels 15 that extend to the side walls 22 are also fully located against longitudinal movement. Also, it is important to secure the panels 15 at the edges against lateral movement toward and away from the side walls and against lifting movement away from the beams 11 of the screen deck.

For this, the side clamps 21 have been configured so that they can support plugs or spacers (hereinafter "plugs") for interaction with the panels 15. With reference to FIGS. 10 to 13, the side clamp 21 includes a rear face 70, a front face 71, an upper stepped edge 72 which is engaged by the wedge 24 for securing the side clamp 21 in place, and a lower or bottom edge 73. Extending from the lower edge 73 are projections 74 that each include an opening 75 for receipt of a plug 76, which is shown in side cross sectional view in FIG. 13.

Figures 10, 13:
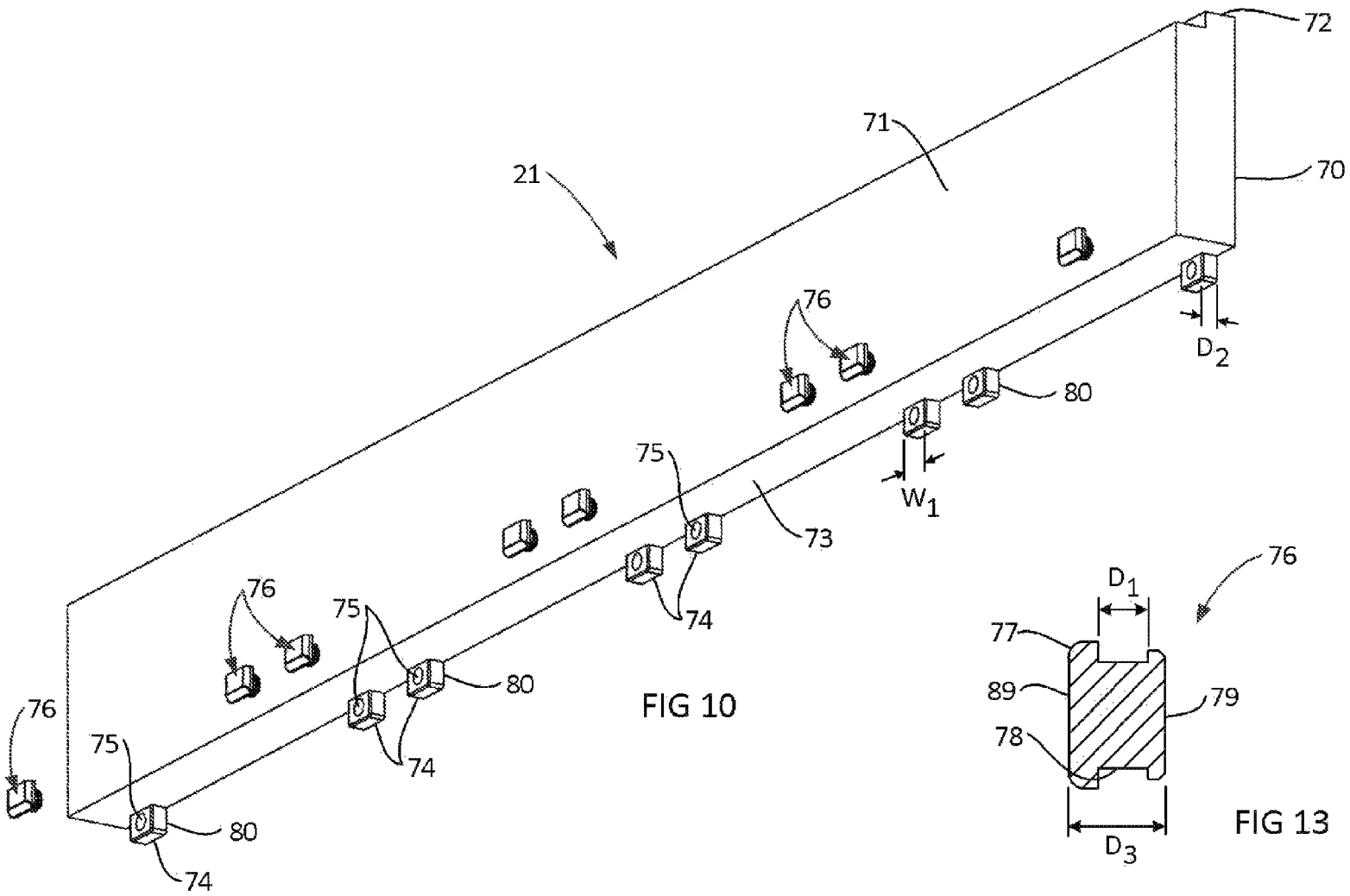
FIG. 10 is an isometric view of a side clamp according to one embodiment of the invention.
FIG. 13 is a cross sectional view of a locking member according to a further embodiment of the invention.

From FIG. 13, it can be seen that the plug 76 has a head 77, a neck 78 and a base 79. The dimensions of the openings 75 are such to snuggly or closely accept the neck 78, and the arrangement is that the base 79 is sufficiently flexible to allow it to be pushed through the smaller diameter opening 75 and to splay or recover once through the opening 75 to engage against the rear surface 80 of the projections 74, with the surface 80 being slightly inboard of the rear face 70 of the side clamp 21 so that the rear of the base 79 is coextensive with the rear face 70. The distance $D_1$ between the bottom surface of the head 77 and the facing surface of the base 79 is also configured to be approximately the same as the distance $D_2$ between front and rear surfaces of the projections 74.

Figure 11:
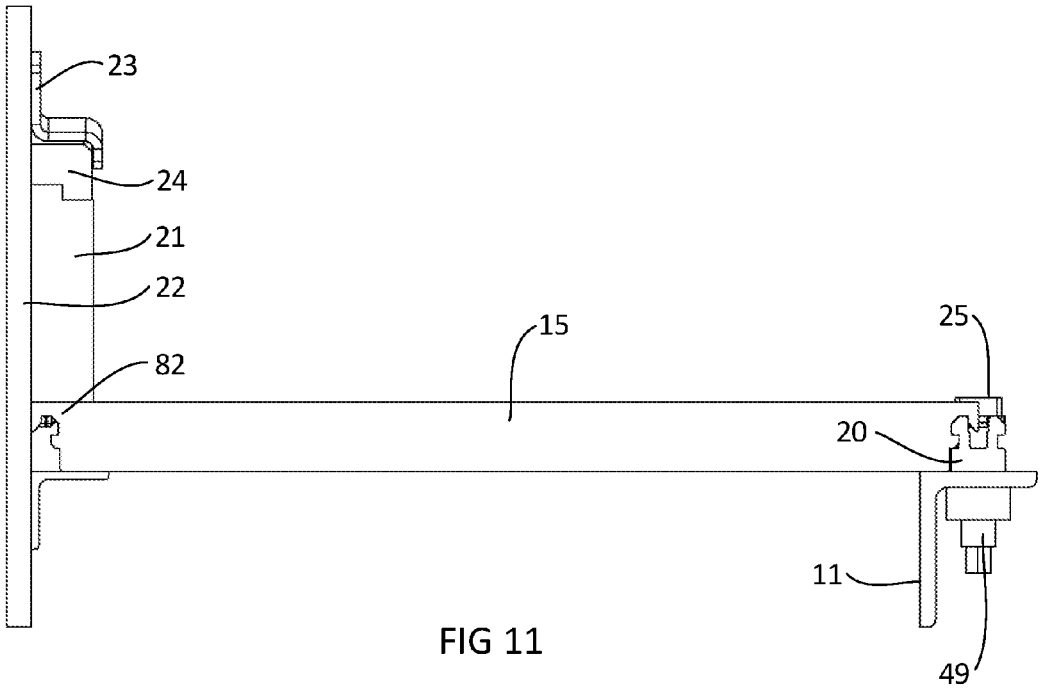
FIG. 11 is an end view taken in the direction A of FIG. 1.
Figure 12:
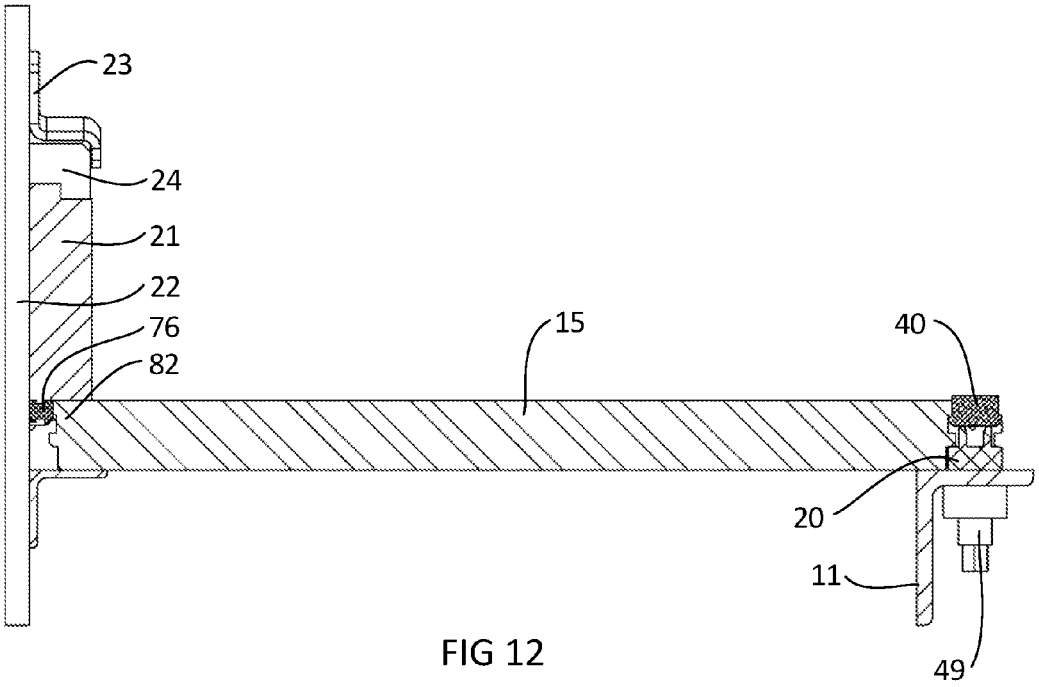
FIG. 12 is a cross sectional view through XII-XII of FIG. 1.

With reference to FIGS. 3 and 4, and assuming for the purposes of the description in relation to the plugs 76, that the side edge 82 of the panel 15 of FIGS. 3 and 4 is the side edge 82 shown in FIGS. 11 and 12, then it will be apparent that the side edge 82 includes openings or gaps 41 (see FIGS. 3 and 4) that are proximate the facing surface of the wall 22. The projections 74 of the side clamp 21 shown in FIG. 10 are therefore spaced apart for alignment with the gaps 41 in the side edge 82. The projections 74 of the side clamp 21 also have a width dimension $W_1$ (see FIG. 10) that is the same, or just slightly smaller than the width dimension $W_2$ of the gaps 41 (see FIG. 4). When the projections 74 are located within the gaps 41, side edges of the projections 74 bear against facing surfaces of the gaps 41 to locate the side edge 82 against longitudinal movement in the direction A (see FIG. 1) between the feed and discharge ends of the screen deck 10. By this arrangement, the side edge 82 is secured against that longitudinal movement to the same extent that that movement is secured at the opposite ends of the panels 15 by the earlier described locking members 25, 40, 60 or 65.

The engagement should be enough to prevent longitudinal movement of the panels 15 in the direction A of FIG. 1. The fit of the projections 74 preferably should therefore be an interference type fit within the gaps 41. The bearing engagement can be firm engagement and the dimensions of the projections 74 and the gaps 41 can be made so that the panels must be forced into position on the projections 74, However, such a tight engagement is not considered to be absolutely necessary, so that a friction fit could be acceptable or even a slightly loose fit.

For the panels 15 to be secured against lateral movement toward and away from the side walls 22 (movement in the direction B as shown in FIGS. 3 and 4), contact must be made with the inside or base surfaces 43 of the gaps 41, It is not intended that the projections 74 will engage the base surfaces 43, although in some arrangements this could occur, but rather, it is the intention that the plugs 76 engage the base surfaces 43, The plugs 76 can be made in different lengths or sizes as explained below, to accommodate variations in the spacing between the base surfaces 43 and the facing surface of the projections 74 of different screening decks or machines, The plugs 76 are proposed to be separate from the projections 74, so that different sized plugs can be used to accommodate different spacing between the base surfaces 43 and the facing surface of the projections 74 as necessary. Thus, in relation to FIG. 14, the side clamp 21 is again shown, having the same features and thus the same reference numerals as the side clamp 21 as shown in FIG. 10. However, in FIGS. 14 and 15, plugs 84 are illustrated and those plugs have a different and reduced depth $D_4$ compared to the depth $D_3$ of the plug 76 of FIG. 13. The plug 84 has a head 85, a neck 86 and a base 87. The dimensions of both the neck 86 and the base 87 can be the same as the neck 78 and the base 79 of the plug 76. Where the dimension differs in the respective plugs 76 and 84 is in the dimension or depth of respective heads 77 and 85. As can be seen in FIGS. 13 and 15, the head 77 is of greater dimension or depth compared to the head 85.

The dimensions of the plug 84 is for snug or close receipt of the neck 86 within the openings 75, with the base 87 being sufficiently flexible to allow it to be pushed through the smaller diameter opening 75 and to splay or recover once through the opening 75 to engage against the rear surface 80 of the projections 74 in the same manner as the plugs 76 of FIGS. 10 and 13.

Figure 14:
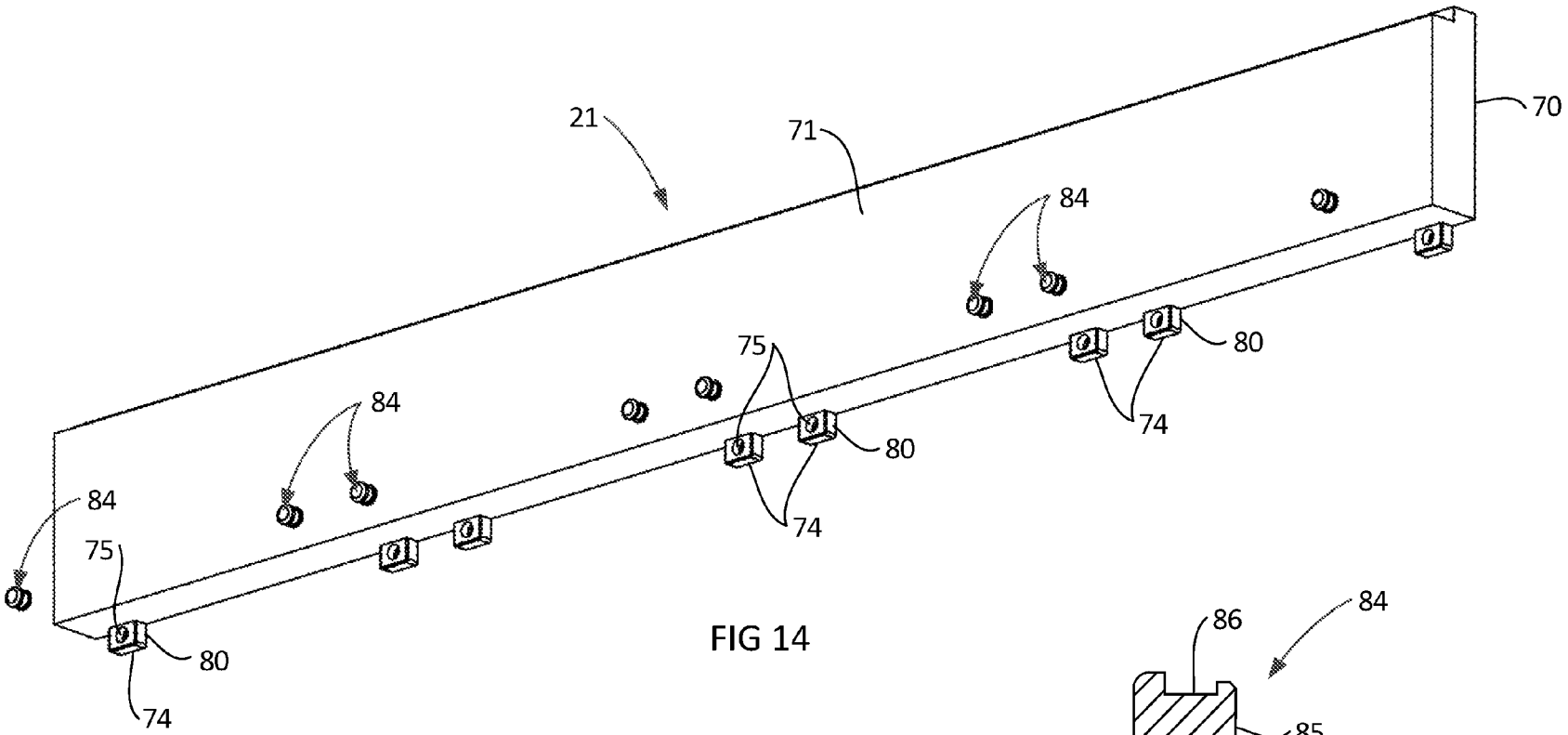
FIG. 14 is an isometric view of a side clamp according to one embodiment of the invention.
Figure 15:
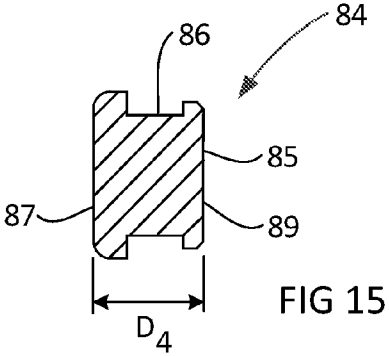
FIG. 15 is a cross sectional view of a locking member according to a further embodiment of the invention.

The different sizes or depth of the plugs 76 and 84 illustrated in FIGS. 10 and 14 allows compensation for slight variations in the total width of the screening deck 10 between the opposite side walls 22 (see FIG. 1). This is important, because while the distance between the side walls 22 is specified for each screening deck, there can be slight variation along the length of the deck between the side walls (such as by slight bowing of the sides walls along their length), so that the size of the plug needed to engage the base surface 43 of the screen panels 15 can also vary. Moreover, different screen deck manufacturers manufacture their screen decks to different widths and where the variation between the width of the screen decks of different manufacturers varies only by a few millimeters (say up to 30 mm), the same side clamp can be used for each deck with the plugs being selected based on the distance that the plugs need to bridge, It is necessary for the plugs 76 and 84 to engage the base surface 43 of the gaps or openings 41. The engagement should be enough to prevent lateral movement of the panels 15 in the direction B of FIGS. 3 and 4. The fit of the plugs 76 and 84 should preferably be an interference type fit so that the faces 89 of the plugs 76 and 84 bear against the base surfaces 43 of the gaps 41. The bearing engagement can be firm engagement. The heads 77 and 85 can be made so that the panels must be forced into position against the plugs 76 and 84, although such a tight engagement is not considered to be absolutely necessary. What is necessary is that the heads 77 and 85 of the plugs 76 and 84 take up the gap between the projections 74 and the facing base surfaces 43 and bear against the base surfaces 43.

The plugs 76 and 84 can have the same width dimension $W_1$ (see FIG. 10) as the projections 74, so that the plugs 76 and 84 can also engage facing surfaces of the gaps 41 in the same way as the projections 74 engage facing surfaces of the gaps 41 to prevent longitudinal movement of the panels 15 in the direction A of FIG. 1. However, this is not a requirement. Also, where the plugs 76 and 84 have the same width dimension $W_1$ as the projections 74, the plugs 76 and 84 might not contribute much to the resistance of longitudinal movement of the panels 15, particularly where the dimension of the head 77 or 85 of the plugs 76 and 84 is small. Where the head dimension is larger, then the plugs 76 and 84 can contribute to the resistance of longitudinal movement.

The invention described herein is susceptible to variations, modifications and/or additions other than those specifically described and it is to be understood that the invention includes all such variations, modifications and/or additions which fall within the spirit and scope of the present disclosure.

The invention claimed is:

1. A screening apparatus, including:

a plurality of spaced apart, substantially parallel elongate beams, a plurality of screen panels mounted to the beams to form a broad, generally planar screening surface, each panel being mounted to a pair of beams to bridge between two adjacent beams, each of the panels having a generally square or rectangular shape defining a first pair of substantially parallel edges and a second pair of substantially parallel edges, and the panels being mounted adjacent to each other so that facing side edges of adjacent panels are in close facing relationship, the panels being mounted to the beams by elongate fixing members that extend in the longitudinal direction of the beams and that engage the first pair of side edges of the panels, the fixing members having a pair of upstanding, generally longitudinal rails that are generally parallel and that are spaced apart to define a longitudinal gap between them, the panels being mounted to the beams by cooperation between the first pair of side edges of each panel with a rail of a fixing member, the first pair of side edges of each panel including a longitudinal overhang that overlies an upper end of a rail and that extends into the gap between the rails, each of the rails of each fixing member and the overhang of each panel being interrupted to form locating gaps that are aligned and within which a locking member is disposed to locate the panel relative to the fixing member against movement of the panel along the fixing member.

2. A screening apparatus according to claim 1, the overhang presenting an engagement surface for engagement with a facing engagement surface of the overhang of an adjacent screen panel within the gap between adjacent rails.

3. A screening apparatus according to claim 2, the engagement surface being a substantially flat surface that extends substantially perpendicular to the plane of the screening surface.

4. A screening apparatus according to claim 2, whereby engagement between the overhangs of adjacent screen panels prevents adjacent rails of a fixing member from flexing towards each other.

5. A screening apparatus according to claim 2, engagement between facing engagement surfaces of respective overhangs of adjacent screen panels extending above the gap between adjacent rails.

6. A screening apparatus according to claim 5, engagement between facing engagement surfaces of respective overhangs of adjacent screen panels extending to the screening surface.

7. A screening apparatus according to claim 1, the cooperation between the first pair of side edges of each panel and a rail of a fixing member including a projection extending from either one of the side edges of each panel and the rail of a fixing member, and a groove formed in the other of the side edges of each panel and the rail of a fixing member, the projection extending into the groove generally in a plane that is parallel to the plane of the screening surface and the projection and groove being located between the beam of the screening apparatus to which screen panels are mounted and the overhang of the screen panels.

8. A screening apparatus according to claim 7, the rails of the fixing members extending from a base and including an upright web section and a head at an upper end of the web section, the groove being formed in each rail between the base and the head, the overhang extending over the head and into the gap between adjacent rails, the portion of the overhang that extends into the gap having an inclined face so that the overhang portion can be pushed into engagement with the head of the rail and the overhang portion will ride along the inclined face as it enters the gap.

9. A screening apparatus according to claim 1, a single locking member substantially filling the space created by the locating gaps formed by a pair of adjacent screen panels and the rails of a fixing member.

10. A screening apparatus according to claim 1, the overhang of each of the first pair of edges of each screen panel including two locating gaps that are spaced apart and the rails of the fixing members including corresponding locating gaps for alignment with the locating gaps of the overhang, the screen panels being located relative to the fixing rail against movement of the panel along the fixing rail by a pair of locking members inserted into the aligned locating gaps.

11. A screening apparatus according to claim 1, each locking member including a pair of projections on opposite sides of the locking member for engaging under a projection formed in the facing edges of adjacent screen panels to locate the locking member within a locating gap formed between adjacent screen panels.

12. A screening apparatus according to claim 11, the projections of the adjacent screen panels being formed in a portion of the overhang of each of the screen panels within which the locating gap is formed.

13. A screening apparatus according to claim 11, the locking member projections being formed to extend generally perpendicular to the longitudinal extent of the fixing members.

14. A screening apparatus according to claim 11, the locking member projections being formed to extend generally parallel to the longitudinal extent of the fixing members.

15. A screening apparatus according to claim 1, the locking members being substantially square or rectangular and defining four walls, a projection extending from each wall for engaging under respective projections formed in facing edges of adjacent screen panels.

16. A screening apparatus according to claim 15, at least two of the projections formed in facing edges of adjacent screen panels being formed in a portion of the overhang of each of the screen panels within which the locating gap is formed.

17. A screening apparatus according to claim 15, all of the projections formed in facing edges of adjacent screen panels being formed in a portion of the overhang of each of the screen panels within which the locating gap is formed.

18. A screening apparatus according to claim 1, the locking members extending to a position above the screening surface to form deflectors.

* * * * *